US011047055B2

(12) United States Patent
Yang et al.

(10) Patent No.: US 11,047,055 B2
(45) Date of Patent: Jun. 29, 2021

(54) METHOD OF DEPOSITING NANOPARTICLES ON AN ARRAY OF NANOWIRES

(71) Applicants: Peidong Yang, Kensington, CA (US); Qiao Kong, El Cerrito, CA (US); Dohyung Kim, Albany, CA (US); Chong Liu, Cambridge, MA (US)

(72) Inventors: Peidong Yang, Kensington, CA (US); Qiao Kong, El Cerrito, CA (US); Dohyung Kim, Albany, CA (US); Chong Liu, Cambridge, MA (US)

(73) Assignee: The Regents of the University of California, Oakland, CA (US)

( * ) Notice: Subject to any disclaimer, the term of this patent is extended or adjusted under 35 U.S.C. 154(b) by 74 days.

(21) Appl. No.: 16/025,594

(22) Filed: Jul. 2, 2018

(65) Prior Publication Data

US 2019/0010622 A1 Jan. 10, 2019

Related U.S. Application Data

(60) Provisional application No. 62/529,620, filed on Jul. 7, 2017.

(51) Int. Cl.

| | |
|---|---|
| ***C25B 11/091*** | (2021.01) |
| ***B05D 3/00*** | (2006.01) |
| ***C25B 1/55*** | (2021.01) |

(52) U.S. Cl.

CPC ..... *C25B 11/091* (2021.01); *B05D 3/007* (2013.01); *C25B 1/55* (2021.01)

(58) Field of Classification Search

CPC ..... C25B 11/0478
USPC ..... 427/376.1
See application file for complete search history.

(56) References Cited

U.S. PATENT DOCUMENTS

| | | | |
|---|---|---|---|
| 4,259,418 | A | 3/1981 | Clark |
| 4,521,499 | A | 6/1985 | Switzer |
| 4,574,039 | A | 3/1986 | Pyke |
| 4,592,807 | A | 6/1986 | Switzer |
| 7,241,950 | B2 | 7/2007 | Fan |

OTHER PUBLICATIONS

Gan et al., ZnO nanowire/TiO2 nanoparticle photoanodes prepared by the ultrasonic irradiation assisted dip-coating method, Thin solid Films, 518 (2010), p. 4809-4812 (Year: 2010).*

Jung et al., Colloidal Nanoparticle-Layer Formation Through Dip-Coating: Effect of Solvents and Substrate Withdrawing Speed, Journal of The Electrochemical Society, 156 (5), p. K86-K90 (2009) (Year: 2009).*

(Continued)

*Primary Examiner* — Tabatha L Penny

(57) ABSTRACT

This disclosure provides systems, methods, and apparatus related to nanostructures. In one aspect, an array of nanowires is provided. The array of nanowires comprises a plurality of nanowires. End of nanowires of the plurality of nanowires are attached to a substrate. A liquid including a plurality of nanoparticles is deposited on the array of nanowires. The liquid is evaporated from the array of nanowires. Nanoparticles of the plurality of nanoparticles are deposited on the nanowires as a meniscus of the liquid recedes along lengths of the plurality of nanowires.

20 Claims, 6 Drawing Sheets

(56) References Cited

OTHER PUBLICATIONS

Jager et al., Design parameters for enhanced photon absorption in vertically aligned silicon nanowire arrays, Nanoscale Res. Lett., 2014, 9(1), p. 1-6 (Year: 2014).*
Choi et al., Sn-Coupled p-Si Nanowire Arrays for Solar Formate Production from CO2, Adv. Energy Mater., 2014, 4, p. 1301614-1301621 (Year: 2014).*
Kim et al., Synergistic geometric and electronic effects for electrochemical reduction of carbon dioxide using gold-copper bimetallic nanoparticles, Nature Communications, Sep. 2014, p. 1-8 (Year: 2014).*
Yoon et al., Single and Multiple-Step Dip-Coating of Colloidal Maghemite (C—Fe2O3) Nanoparticles onto Si, Si3N4, and SiO2 Substrates, Adv. Func. Mater., 2004, 14, No. 11, November, p. 1062-1068 (Year: 2004).*
Yuhas, Nanowire-Based All-Oxide Solar Cells, J. Am. Chem. Soc., 2009, 131, p. 3756-3761 (Year: 2009).*
Deegan, Contact line deposits in an evaporating drop, Physical Review E, vol. 62, No. 1, Jul. 2000, p. 756-765 (Year: 2000).*
Li, Anisotropic Nanomaterials: Preparation, Properties, and Applications, NanoScience and Technology, 2015, p. 30-32 (Year: 2015).*
Wetterskog, Precise control over shape and size of iron oxide nanocrystals suitable for assembly into ordered particle arrays, 2014, Sci. Technol. Adv. Mater., 15, 055010, p. 1-9 (Year: 2014).*
Suehiro, Efficient solution route to transparent ZnO semiconductor films using colloidal nanocrystals, Journal of Asian Ceramic Societies, 4 (2016), p. 319-323 (Year: 2016).*
Kong, Directed Assembly of Nanoparticle Catalysts on Nanowire Photoelectrodes for Photoelectrochemical CO2 Reduction, Nano Letters, 2016, 16, p. 5675-5680 (Year: 2016).*
Schreier, M., et al. "Covalent Immobilization of a Molecular Catalyst on Cu2O Photocathodes for CO2 Reduction" J. Am. Chem. Soc. 2016, 138, 1938-1946.
Qiu, J., et al. "Artificial Photosynthesis on TiO2-Passivated InP Nanopillars" Nano Lett. 2015, 15, 6177-6181.
Choi, S. K., et al., "Sn-Coupled p-Si Nanowire Arrays for Solar Formate Production from CO2" Adv. Energy Mater. 2014, 4, 1301614.
Alotaibi, B., et al. "Wafer-Level Artificial Photosynthesis for CO2 Reduction into CH4 and CO Using GaN Nanowires" ACS Catal. 2015, 5, 5342-5348.
Torralba-Penalver, E., et al. "Selective Catalytic Electroreduction of CO2 at Silicon Nanowires (SiNWs) Photocathodes Using Non-Noble Metal-Based Manganese Carbonyl Bipyridyl Molecular Catalysts in Solution and Grafted onto SiNWs" ACS Catal. 2015, 5, 6138-6147.
Yunker, P. J., et al. "Suppression of the coffee-ring effect by shape-dependent capillary interactions" Nature 2011, 476, 308-311.
Chi, L. F., et al. "Nanoscopic channel lattices with controlled anisotropic wetting" Nature 2000, 403, 173-175.
Huang, J., et al. "Spontaneous formation of nanoparticle stripe patterns through dewetting" Nat. Mater. 2005, 4, 896-900.
Zheng, N., et al. "A General Synthetic Strategy for Oxide-Supported Metal Nanoparticle Catalysts" J. Am. Chem. Soc. 2006, 128, 14278-14280.
Rabini, E., et al. "Drying-mediated self-assembly of nanoparticles" Nature 2003, 426, 271-274.
Liu, C., et al. "A Fully Integrated Nanosystem of Semiconductor Nanowires for Direct Solar Water Splitting" Nano Lett. 2013, 13, 2989-2992.
Warren, E. L., et al. "pH-Independent, 520 mV Open-Circuit Voltages of Si/Methyl Viologen2+/+ Contacts Through Use of Radial ni+p-Si Junction Microwire Array Photoelectrodes" J. Phys. Chem. C 2011, 115, 594-598.
Kong, Q., et al., Directed Assembly of Nanoparticle Catalysts on Nanowire Photoelectrodes for Photoelectrochemical CO2 Reduction, Nano Lett., 2016, 16 (9), pp. 5675-5680.

* cited by examiner nanoparticles in solution
nanoparticles on substrate

METHOD OF DEPOSITING NANOPARTICLES ON AN ARRAY OF NANOWIRES

RELATED APPLICATIONS

This application claims priority to U.S. Provisional Patent Application No. 62/529,620, filed Jul. 7, 2017, which is herein incorporated by reference.

STATEMENT OF GOVERNMENT SUPPORT

This invention was made with government support under Contract No. DE-AC02-05CH11231 awarded by the U.S. Department of Energy. The government has certain rights in this invention.

TECHNICAL FIELD

This disclosure relates generally to nanostructures and more particularly to a method of depositing nanoparticles on an array of nanowires.

BACKGROUND

Techniques that can be used to deposit nanoparticles onto nanowires and arrays of nanowires include chemical vapor deposition (CVD), atomic layer deposition (ALD), electrodeposition, sputtering, and evaporation. In these techniques, the nanoparticle is created during the deposition of the nanoparticle. In some instances, due to the nanoparticle being created during the deposition of the nanoparticle, it may be difficult to obtain nanoparticles of specific compositions, sizes, and/or shapes.

SUMMARY

One innovative aspect of the subject matter described in this disclosure can be implemented in a method including providing an array of nanowires. The array of nanowires comprises a plurality of nanowires. End of nanowires of the plurality of nanowires are attached to a substrate. A liquid including a plurality of nanoparticles is deposited on the array of nanowires. The liquid is evaporated from the array of nanowires. Nanoparticles of the plurality of nanoparticles are deposited on the nanowires as a meniscus of the liquid recedes along lengths of the plurality of nanowires.

Another innovative aspect of the subject matter described in this disclosure can be implemented in a method including providing an array of nanowires. The array of nanowires comprises a plurality of nanowires. Ends of nanowires of the plurality of nanowires are attached to a substrate. The nanowires and the substrate comprise silicon. A liquid including a plurality of nanoparticles is deposited on the array of nanowires. The liquid comprises hexane. The plurality of nanoparticles comprises $Au_3Cu$. The liquid is evaporated from the array of nanowires. Nanoparticles of the plurality of nanoparticles are deposited on the nanowires as a meniscus of the liquid recedes along lengths of the plurality of nanowires.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

DETAILED DESCRIPTION

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise.

The terms "about" or "approximate" and the like are synonymous and are used to indicate that the value modified by the term has an understood range associated with it, where the range can be ±20%, ±15%, ±10%, ±5%, or ±1%. The term "substantially" is used to indicate that a value is close to a targeted value, where close can mean, for example, the value is within 80% of the targeted value, within 90% of the targeted value, within 95% of the targeted value, or within 99% of the targeted value.

Figure 1:
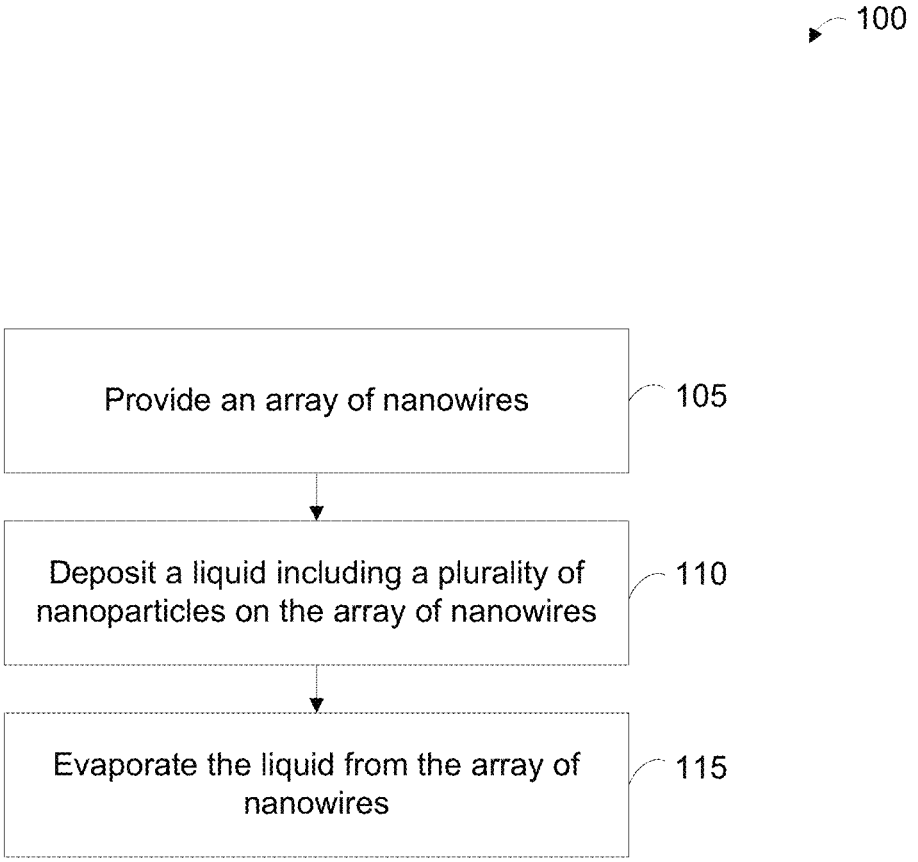
FIG. 1 shows an example of a flow diagram illustrating a process for depositing nanoparticles on an array of nanowires.

FIG. 1 shows an example of a flow diagram illustrating a process for depositing nanoparticles on an array of nanowires. Starting at block 105 of the method 100 shown in FIG. 1, an array of nanowires is provided. The array of nanowires comprises a plurality of nanowires, with ends of nanowires of the plurality of nanowires being attached to a substrate. In some embodiments, the nanowires are substantially perpendicular to the substrate.

In some embodiments, ends of nanowires of the plurality of nanowires being attached to a substrate is due to the fabrication process for the plurality of nanowires. For example, when nanowires are produced using a photoresist as a mask and etching a surface of a substrate, ends the nanowires will remain attached to the surface of the substrate.

In some embodiments, lengths of the nanowires are about 1 micron to 50 microns, or about 20 microns to 30 microns. In some embodiments, the nanowires have a cross section selected from a group consisting of a square cross section, a triangular cross section, an oval cross section, and a circular cross section. Nanowires with a circular cross section (i.e., the nanowires are cylindrical) have a smaller surface area per unit volume compared to other cross-sectional shapes. In some embodiments, dimensions of cross sections of the nanowires are about 300 nanometers (nm) to 1.5 microns. For example, when the nanowires have a circular cross section, the diameters of the nanowires may be about 300 nm to 1.5 microns. In some embodiments, an aspect ratio (length to cross-sectional dimension) of the nanowires is about 2 to 50 or about 3 to 30.

Nanowires of the array of nanowires have a spacing or distance between the nanowires. In some embodiments, the distance between the nanowires is the cross-sectional dimension of the nanowires. For example, if the nanowires are cylindrical and have a diameter (i.e., the cross-sectional dimension) of about 500 nm, the distance between the nanowires may be about 500 nm. In some embodiments, a distance between nanowires is at least about 100 nanometers. If the distance between nanowires is not large enough, the liquid deposited on the array of nanowires at block 110 may not wet the nanowires due to surface tension effects. In some embodiments, a center-to-center spacing of the nanowires is about 500 nm to 3 microns.

In some embodiments, the nanowires comprise a semiconductor. For example, the nanowires may comprise a semiconductor that absorbs light. In some embodiments, the nanowires comprise a p-type semiconducting material or a n-type semiconducting material. In some embodiments, the nanowires comprise a material selected from a group consisting of silicon, gallium arsenide, and indium phosphide. In some embodiments, the nanowires comprise an oxide, such as iron oxide (e.g., $Fe_2O_3$), titanium oxide, zinc oxide (e.g., ZnO), or nickel oxide (e.g., $NiO_x$), for example. In some embodiments, the nanowires comprise a metal (e.g., a metallic element, a transition metal, or an alloy).

In some embodiments, the nanowires have a surface roughness. When surfaces of the nanowires are rough, the surface area of the nanowires is increased. For example, in some embodiments, a surface roughness of the nanowires is about 20 nm root mean square roughness to 50 nm root mean square roughness.

At block 110, a liquid including a plurality of nanoparticles is deposited on the array of nanowires. In some embodiments, nanoparticles of the plurality of nanoparticles have ligands disposed on surfaces of the nanoparticles so that the nanoparticles are soluble in the liquid (i.e., a solvent). In some embodiment, the liquid is hydrophobic. In some embodiments, the liquid is selected from a group consisting of hexane, chloroform, and toluene. In some embodiments, the ligands comprise hydrocarbon chains comprising about 10 to 18 carbon atoms. The ligands attach to the surfaces of the nanoparticles via functional groups. In some embodiments, the functional groups are selected from a group consisting of phosphine, amine, carboxylate, and thiol. In some embodiments, a concentration of the plurality of nanoparticles in the liquid when the liquid is deposited on the array of nanowires is about 0.1 milligrams per milliliter (mg/mL) to 1 mg/mL, or about 0.7 mg/mL. In some embodiments, about 10 microliters to 50 microliters of liquid is deposited per centimeter squared of nanowires (i.e., per centimeter squared of the substrate to which the nanowires are attached).

In some embodiments, the nanoparticles have a shape selected from a group consisting of a cube, a sphere, a rod (i.e., nanorods), a pyramid, and an octahedron. In some embodiments, spherical nanoparticles are used. Spherical nanoparticles have the smallest amount of surface area of the nanoparticles exposed to the external environment per unit volume. In some embodiments, the nanoparticles have dimensions of about 2 nm to 30 nm. For example, when the nanoparticles are spherical, a diameter of the nanoparticles may be about 2 nm to 30 nm.

In some embodiments, the nanoparticles comprise a metal. For example, the metal may be an elemental metal (e.g., iron or titanium), a bimetallic metal, a trimetallic metal, or an alloy. In some embodiments, the nanoparticles comprise an oxide. In some embodiments, the nanoparticles comprise a semiconductor (e.g., cadmium selenide (CdSe)).

At block 115, the liquid is evaporated from the array of nanowires. As the liquid evaporates, nanoparticles of the plurality of nanoparticles are deposited on the nanowires as a meniscus of the liquid recedes along lengths of the plurality of nanowires. In some embodiments, all of the liquid or substantially all of the liquid is evaporated in about 15 seconds to 1 minute, or about 30 seconds. A nanoparticle is deposited onto a nanowire with ligands between the nanoparticle and the nanowire. The functional group of the ligand interacts with the nanoparticle and the other end of the ligand is in contact with the nanowire surface.

The rate of evaporation of the liquid, the aspect ratio of the nanowires, and the concentration of the nanoparticles in the liquid control, in part, the nanoparticle coverage of the nanowires. When the rate of evaporation of the liquid is low (i.e., slow drying), the nanoparticles may form aggregates due to interactions of ligands on the nanoparticles. These aggregations of nanoparticles may attach to the surfaces of the nanowires. These aggregations may not be desirable as the surface area of the nanoparticles exposed to the external environment is diminished. When the rate of evaporation of the liquid is high (i.e., fast drying), the nanoparticles may be deposited on the nanowires as individual nanoparticles with no aggregation.

The rate of evaporation can be controlled by the temperature at blocks 110 and 115. In general, a high temperature leads to faster evaporation. In some embodiments, the temperature is about 10° C. to 50° C. at blocks 110 and 115. The temperature is generally below the boiling point of the liquid. The rate of evaporation can also be controlled by the vapor pressure of the liquid in a container in which the liquid is being evaporated from the array of nanowires. For example, a high vapor pressure of the liquid in the container leads to slower evaporation. The temperature and the vapor pressure of the liquid can be specified to obtain a specified rate of evaporation.

The aspect ratio of the nanowires and the concentration of the nanoparticles in the liquid also control the nanoparticle coverage on the nanowires (i.e., the density of the nanoparticles on the nanowires). For example, if the concentration of the nanoparticles in the liquid is high (e.g., about 0.95 mg/mL to 1 mg/mL) and the aspect ratio of the nanowires is low, nanoparticles may settle onto the substrate instead of being deposited on the nanowires. With a low concentration of nanoparticles in the liquid (e.g., about 0.1 mg/mL to 0.2 mg/mL), the nanoparticles may not settle onto the substrate. However, the coverage of the nanoparticles on the nanowires may be low. In this case, to obtain a higher coverage of the nanoparticles on the nanowires, blocks 110 and 115 may be repeated. For example, in some embodiments, after block 115, the liquid including the plurality of nanoparticles is deposited on the array of nanowires a second time. The liquid is again evaporated from the array of nanowires, during which time the nanoparticles are deposited on the nanowires as a meniscus of the liquid recedes along lengths of the plurality of nanowires. Blocks 110 and 115 can be repeated a specified number of time to obtain a specified coverage of the nanoparticles on the nanowires.

In some embodiments, additional ligands are added to the liquid in which the plurality of nanoparticles are dispersed. In some embodiments, the additional ligands are the same ligands that are attached to the nanoparticles. These additional ligands increase the solubility of the nanoparticles in the liquid. The additional ligands may have the effect of generating a lower coverage of nanoparticles on the surfaces of the nanowires. In some embodiments, 0.01 mL to 0.2 mL of ligands per mL of liquid is added to the liquid including the nanoparticles.

The following examples are intended to be examples of the embodiments disclosed herein, and are not intended to be limiting. In the examples, one goal was to create a high surface area surface in which charge extracted from a semiconductor absorbing light could be used by nanoparticles to covert carbon dioxide to carbon monoxide.

EXAMPLES

Directed assembly of nanoparticle (NP) catalysts on nanowire (NW) light absorbers was demonstrated to create an integrated photoelectrode for photoelectrochemical reduction of $CO_2$. $TiO_2$-protected $n^+p$-Si NW arrays were fabricated in parallel with a $Au_3Cu$ NP catalyst featuring high turnover and mass activity for $CO_2$-to-CO conversion, as CO is one of the attractive targets in artificial photosynthesis. Photoelectrochemical production of CO in aqueous environments is appealing as it enables generation of syngas using a renewable energy source. Syngas produced in this manner can serve as a basis for a variety of commodity chemicals converted at the downstream.

Figures 2A, 2B, 2C:
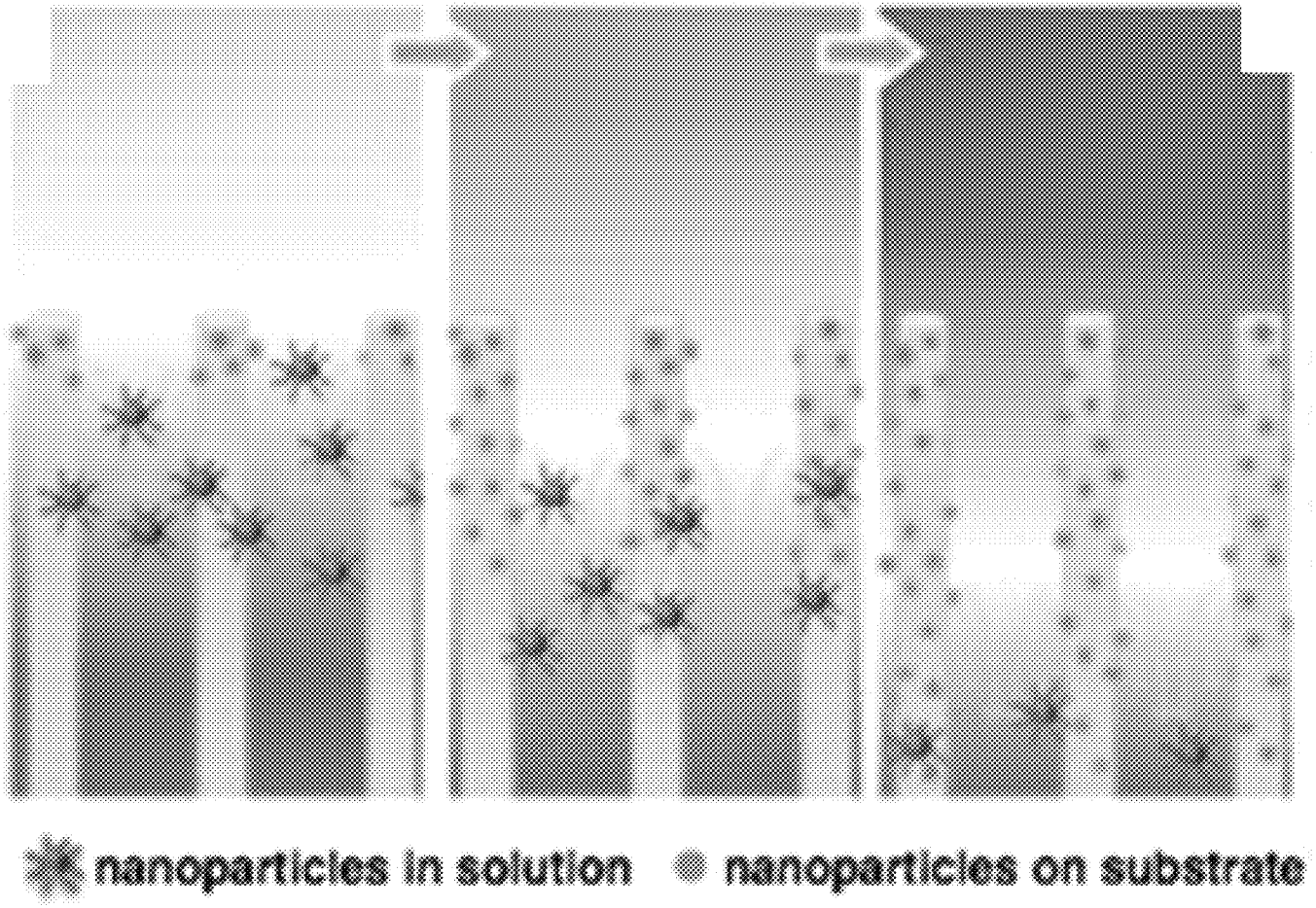
FIGS. 2A-2C show examples of schematic illustrations of the nanoparticle assembly process.
Figures 3A, 3B, 3C, 3D:
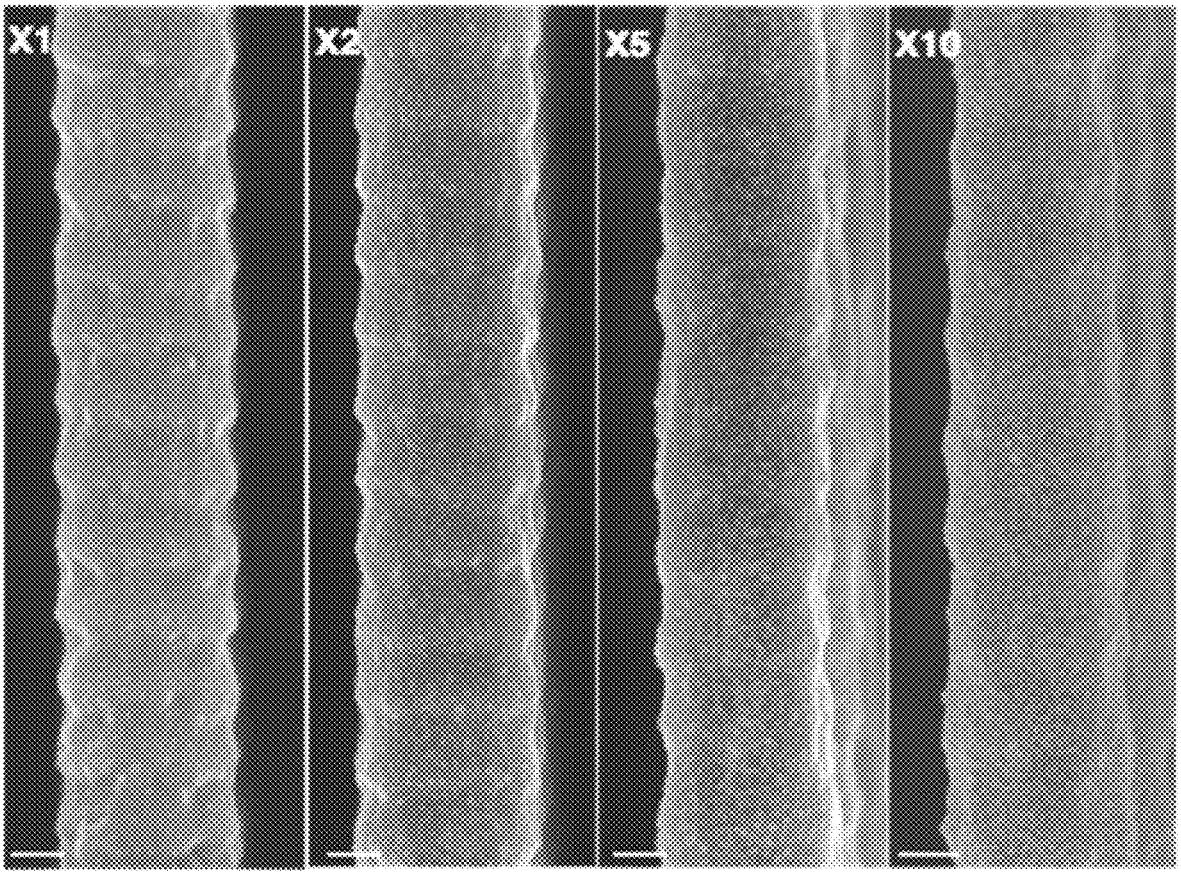
FIGS. 3A-3D show example of SEM images (scale bar 200 nm) demonstrating uniform and tunable NP assembly on Si NW arrays. The numbers (i.e., ×1, ×2, ×5, and ×10) indicate loading amounts that have been proportionally varied.

In a drop-casting process, the NW geometry allows the NP solutions to dry in a unidirectional manner with a receding meniscus along the wires, and as a result the NPs are uniformly decorated onto the NW surfaces. A schematic illustration of this is shown in FIGS. 2A-2C. This feature is in contrast to what is typically observed on planar substrates, where the entire NP solution breaks up into individual droplets to form ring patterns or islands upon drying. This observation shows that the one-dimensionality of NWs serves as a guide in directing the uniform spatial arrangement of NP catalysts onto the NW surface, enabling easy and reproducible assembly of the $CO_2$ reduction photoelectrode with well-defined semiconductor-catalyst interface. In these experiments, the NWs were attached to a substrate that was about 1 cm by 1 cm. The amount of liquid deposited on the NWs was about 10 microliters to 50 microliters.

Scanning electron microscopy (SEM) images confirmed the controllable uniform assembly of individual NPs with varying loading amounts, as shown in FIGS. 3A-3D. The uniformity can be maintained even for very large surface coverage. This is particularly important as it allows effective utilization of their nanoscale surface for catalysis. Scanning transmission electron microscopy (STEM) and elemental mapping further confirmed the presence of uniformly distributed $Au_3Cu$ NPs. In contrast, NP assembly on planar substrates with identical procedures typically resulted in the formation of islands where nanoparticles were aggregated.

Figure 4:
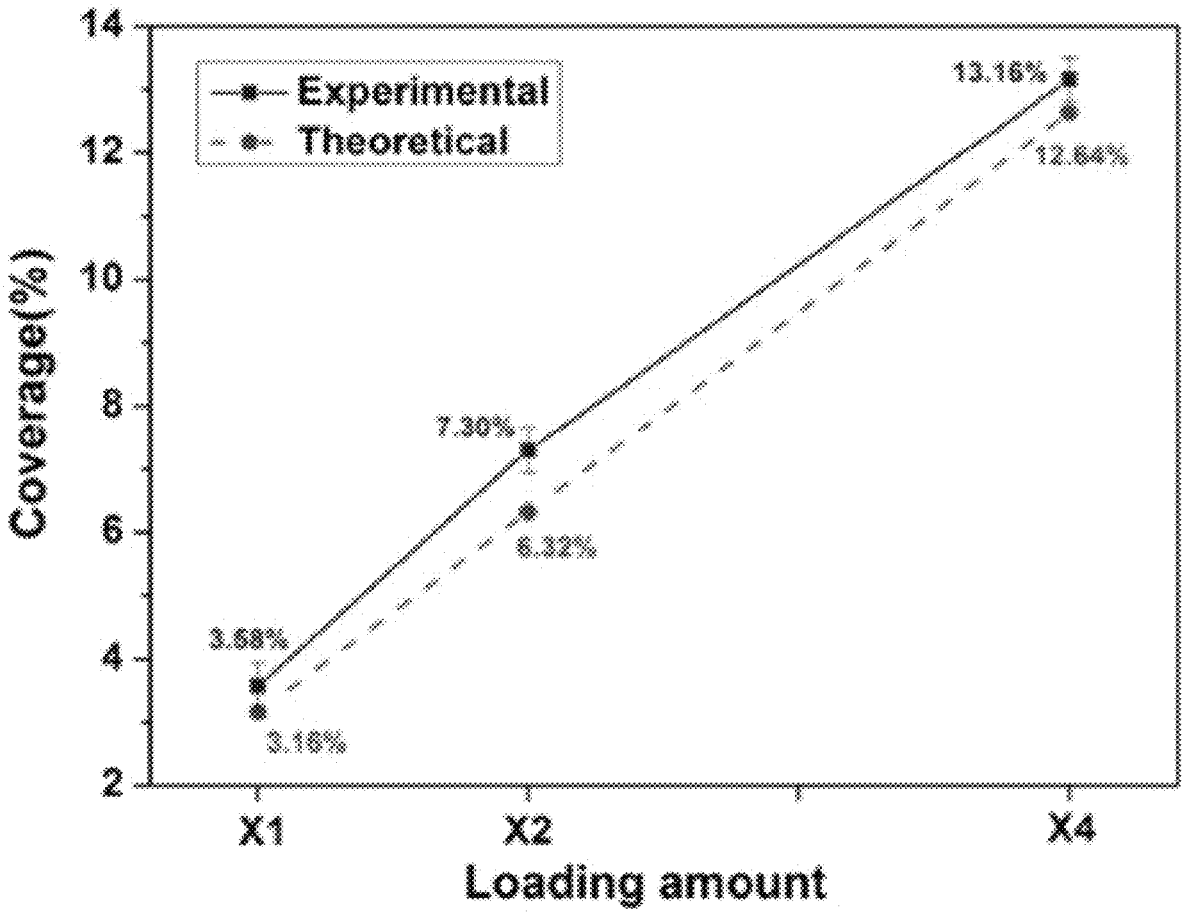
FIGS. 4 and 5 show a quantitative analysis of $Au_3Cu$ NP assembly on NW substrates with ×1, ×2, and ×4 loading amounts.

Quantitative analysis of NP coverage on NW arrays shows a close match between experimental value and the theoretical estimate, assuming NPs are well-dispersed across the NW surface. FIG. 4 shows the experimental determination of NP coverage (area fraction out of the total area provided) on NW surface compared to the theoretical estimate assuming NPs are isolated and well-dispersed. The numbers in FIG. 4 illustrate the overall coverage of $Au_3Cu$ NPs on NW surface. The experimentally determined coverage is an average of multiple wires with each wire measured along its entire length.

Figure 5:
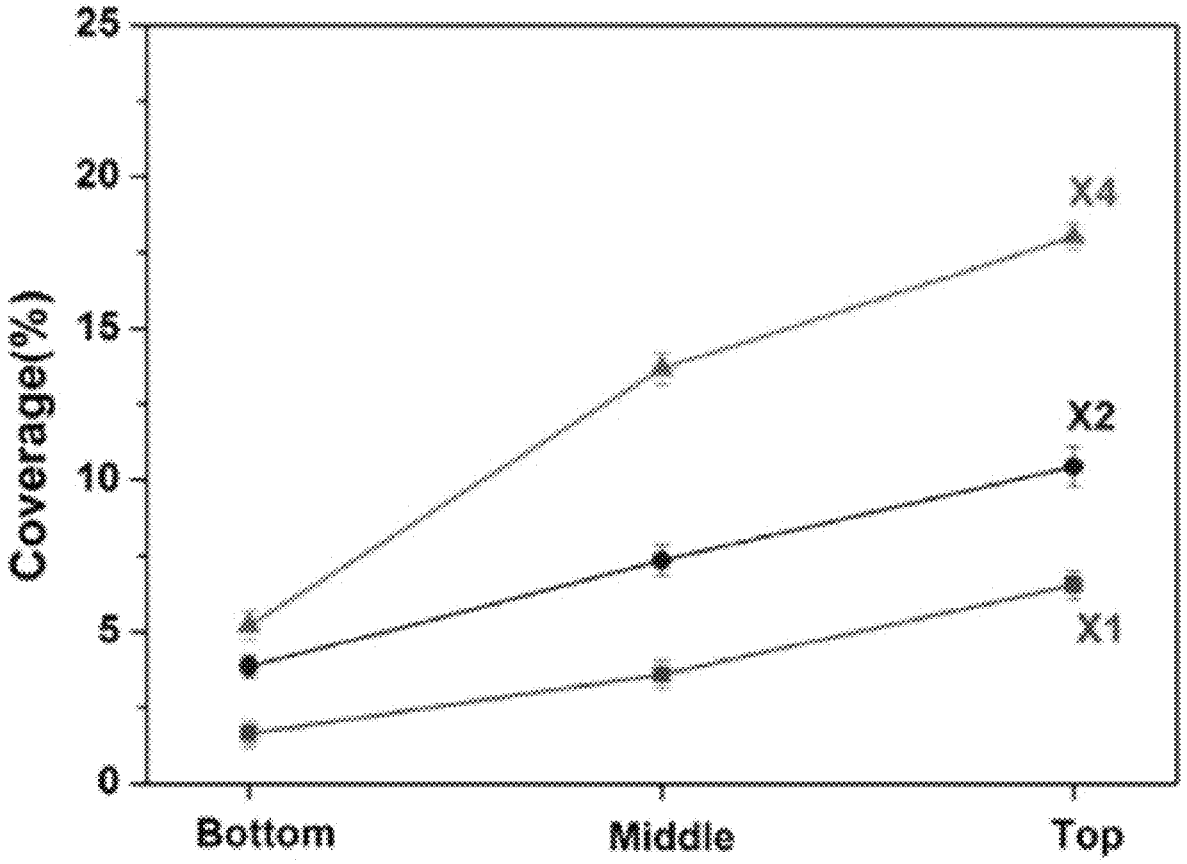
Figure 6:
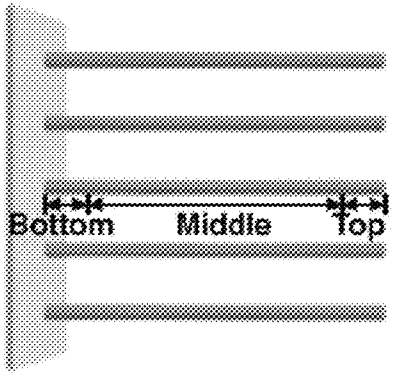
FIG. 6 shows the division of each nanowire into multiple sections along its length that was used to generate FIG. 5.

FIG. 5 shows a detailed analysis of different segments along the NW. To generate FIG. 5, a NP assembly was quantitatively analyzed by dividing each nanowire into multiple sections along its length, as shown in FIG. 6. When divided into eight segments, six segments in the middle had NP coverages that are similar in value with a narrow deviation. The quantitative coverages of the middle section shown in FIG. 5 are an average of middle six segments on multiple wires. Top and bottom are the other two ⅛'s at the end of each nanowire. FIG. 5 shows that the NP distribution exhibits a relatively higher coverage at the top. This can be explained by the unidirectional drying process of the NP solution guided by the NW geometry where the top section of the wires would have been exposed to a relative higher concentration of NPs.

Figure 7:
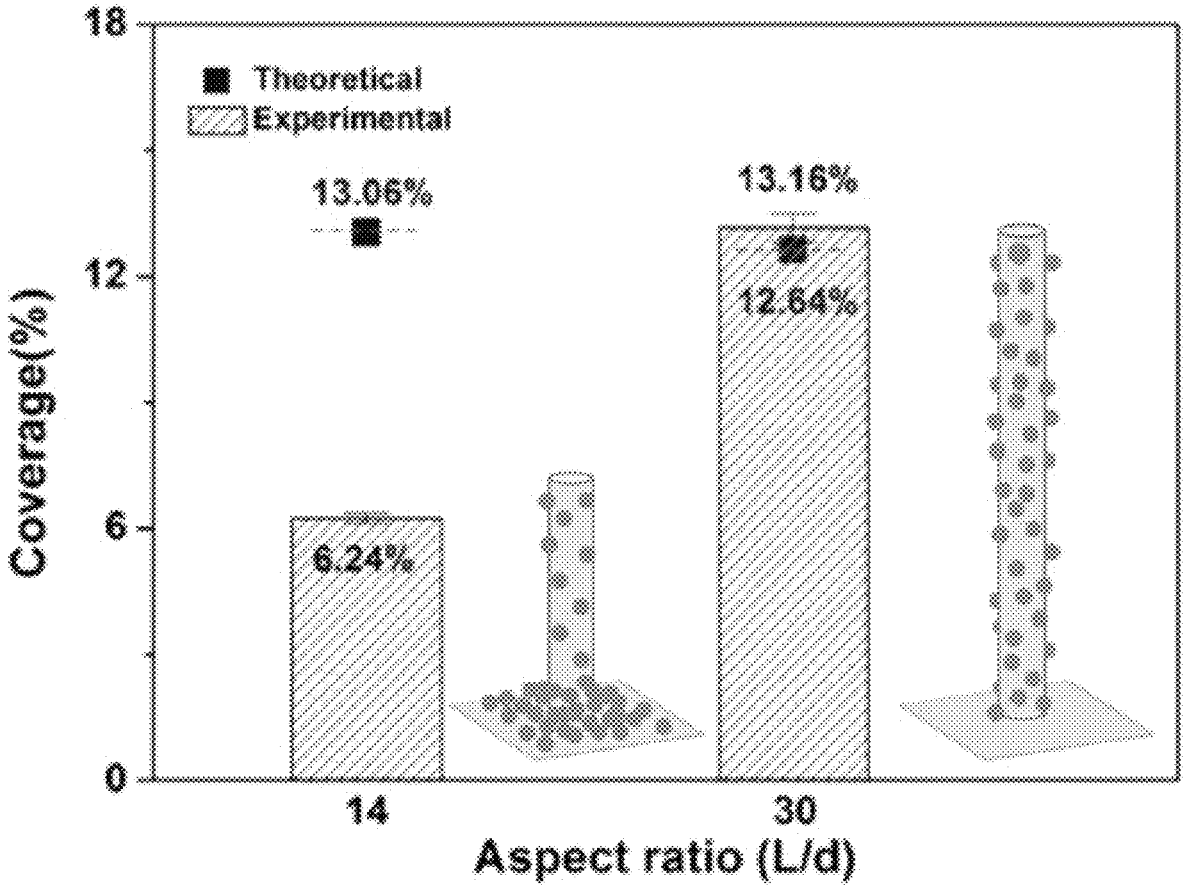
FIG. 7 shows the effect of NW aspect ratio on NP assembly. Aspect ratio is defined as the ratio of the NW length (L) to the diameter (d). In this case, length is the only variable while the diameter is kept the same. The error bars are from quantitative analysis of multiple wires throughout each substrate.

The hypothesis of particle deposition with a receding meniscus along the NW surface suggests that the aspect ratio of the nanowires needs to be large enough to accommodate all the NPs in solution before the liquid front reaches the bottom part of the wires. With lower aspect ratio NWs, nearly half of the NPs settled to the base of the substrate, as shown in FIG. 7. This observation indicates that high surface area (relative to the NPs to be deposited) of the NWs alone is not the determining factor to guarantee a well-dispersed loading. Directed assembly process mediated by NW one-dimensionality with a sufficient aspect ratio is what allows this drop-casting method to be useful.

NPs being deposited onto the NWs while the liquid front moving implies an attractive interaction between the substrate surface (stationary phase) and the metal nanoparticles. At the same time, a counteracting particle-solvent interaction should be present allowing NPs to stay in the solution (mobile phase). While the solution drying process is mediated by the NW substrate, a balance between these interactions at the microscopic level may also be critical.

To test this hypothesis, the amount of surface ligands was tuned where less ligand would allow stronger interactions between the NP and the NW and vice versa. When the NPs were deprived of the ligands, identical loading procedure resulted in clustering and dense coverage at the top part of the wires with only few NPs from the middle to the bottom segment). In contrast, if more ligands were introduced, a large portion of the particles was found at the base of the substrate. These results indicate that with the balanced interactions present, one-dimensionality of the NW geometry facilitates the directed NP assembly by drop-casting a NP solution and letting it dry.

Example 1

Fabrication of the Silicon Nanowire Array Substrates.

Wafer-scale silicon nanowire arrays were fabricated by deep reactive-ion etching (DRIE) method on photoresist patterned single crystalline silicon wafers. In a typical procedure, a p-type boron-doped 6" Si wafer (<100> oriented, 1~5 Ohm·cm) was patterned with a dot array arranged on a square lattice with a 2 μm pitch using a standard photolithography stepper. This wafer underwent a low-frequency inductive-coupled plasma DRIE process to produce nanowire arrays with uniform length ~22.5 μm and diameter ~850 nm. After removing the photoresist residue with 02 plasma, ~100 nm of dry thermal oxide shell was grown on the nanowires at 1050° C. for 100 minutes. 10:1 buffered hydrogen fluoride (BHF) was used to remove silicon oxide. Rinsed with $H_2O$ (18.2 MOhm·cm resistivity) and acetone and dried under a stream of $N_2$ (g), silicon nanowire arrays with diameter ~750 nm were obtained.

Example 2

Fabrication of $TiO_2$-Protected $n^+p$-Si Planar (PL) and NW Array Substrates.

To improve the photovoltage output, heavily arsenic-doped $n^+$ layer was formed on Si PL and NW substrate surface. A silicon handle wafer was first spin-coated with arsenic-containing spin-on dopant (SOD) at 2200 rpm for 30 seconds and then baked at 150° C. on a hotplate for 30 minutes. Subsequently, Si PL and NW chips (both <100> oriented, boron-doped, 1~5 Ohm·cm) were placed upside down on the SOD-coated silicon handle wafer and subjected to rapid thermal annealing (RTA) at 900° C. for 3 minutes in $N_2$ atmosphere. These chips were taken out carefully from RTA chamber after cooling down under a $N_2$ ambient and soaked into 10:1 BHF for ~30 seconds to remove the thin oxide formed during $n^+$ doping process. After that, these chips were rinsed with $H_2O$ (18.2 MOhm·cm resistivity) and acetone and dried under $N_2$ (g) stream. These $n^+p$-Si PL and NW chips were immediately transferred into an ALD (atomic layer deposition) chamber. A thin $TiO_2$ layer (10 nm) was uniformly coated onto the surface to protect substrates from corrosion in the photoelectrochemical measurement.

Example 3

Synthesis and Characterization of $Au_3Cu$ NP.

$Au_3Cu$ NPs were synthesized via the coreduction of both metal precursors. First, 20 mL of 1-octadecene was heated to 130° C. under nitrogen atmosphere. After cooling back to room temperature, 2 mmol of oleic acid, 2 mmol of oleylamine, 0.6 mmol of gold acetate, 0.2 mmol of copper acetate and 4 mmol of 1,2-hexadecanediol were added. Under the inert atmosphere, the mixture was heated to 200° C. and kept at that temperature for 2 hours while stirring. Afterwards, it was further heated to 280° C. for 1 hour. Then, the reaction was stopped by cooling it down to room temperature. Ethanol was added to the mixture to precipitate the synthesized nanoparticles. The nanoparticles were washed once more with hexane and ethanol by centrifugation.

Example 4

Assembly of $Au_3Cu$ NPs on Si PL and NW Substrates.

90 μL of $Au_3Cu$ NP solution was added to 210 μL hexane and sonicated for 15 seconds. Then, different amounts of the solution (18 μL is denoted as ×1 loading with NP loading mass of 4 μg; ×2 to ×10 represents proportionally increased loading amounts) were drop-casted on 0.8 cm*0.8 cm $TiO_2$-protected $n^+p$-Si PL and NW array square pieces and dried spontaneously. Surfactant residues were removed by soaking square pieces into pure acetic acid for 90 seconds, followed by immersing into N, N-Dimethylmethanamide (DMF) for 1 minute and subsequently into ethanol for 15 seconds. Finally, all Si PL and NW array square pieces with $Au_3Cu$ NP loading were dried under $N_2$ stream. ×2 loading was used to demonstrate photoelectrochemical reduction of $CO_2$.

NP coverage on NW substrates was analyzed by counting the number of particles and measuring the size of each particle in a given area using particle analysis. Multiple measurements were performed at different regions across the substrate and NWs were sectioned into eight segments along the wire axis to perform quantitative analysis along the entire length. Theoretical estimates were obtained by assuming well-dispersed NPs on NW surface without any aggregation. Considering projected cross-sectional area of each NP to the NW surface, the theoretical coverage is represented as the ratio of the overall projected area of all NPs to the entire surface area of the NW array substrate.

Further description of experiments performed with the silicon nanowire arrays with $Au_3Cu$ nanoparticles disposed thereon for photoelectrochemical reduction of $CO_2$ can be found in Qiao Kong et al., Directed Assembly of Nanoparticle Catalysts on Nanowire Photoelectrodes for Photoelectrochemical $CO_2$ Reduction, Nano Lett., 2016, 16 (9), pp 5675-5680, which is herein incorporated by reference.

CONCLUSION

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

What is claimed is:

1. A method comprising:

(a) providing an array of nanowires, the array of nanowires comprising a plurality of nanowires, ends of nanowires of the plurality of nanowires being attached to a substrate;

(b) depositing a liquid on the array of nanowires in a drop-casting process, the liquid including a plurality of nanoparticles and including a plurality of first ligands, surfaces of nanoparticles of the plurality of nanoparticles having second ligands disposed thereon; and (c) evaporating the liquid from the array of nanowires, the nanoparticles being deposited on the nanowires as a meniscus of the liquid recedes along lengths of the plurality of nanowires during evaporation of the liquid, a rate of the evaporating being controlled by a temperature at which the evaporating is performed and a vapor pressure of the liquid in a volume in which the evaporating is performed, the evaporating being performed at the temperature of about 10° C. to 50° C., the rate of the evaporating specified such that the nanoparticles are deposited on the nanowires with no aggregation of the nanoparticles.

2. The method of claim 1, wherein lengths of the nanowires are about 1 micron to 50 microns.

3. The method of claim 1, wherein an aspect ratio of the nanowires is about 2 to 50.

4. The method of claim 1, wherein a distance between nanowires is at least about 100 nanometers.

5. The method of claim 1, wherein a center-to-center spacing of the nanowires is about 500 nanometers to 3 microns.

6. The method of claim 1, wherein the nanowires have a cross section selected from a group consisting of a square cross section, a triangular cross section, an oval cross section, and a circular cross section.

7. The method of claim 1, wherein dimensions of cross sections of the nanowires are about 300 nanometers to 1.5 microns.

8. The method of claim 1, wherein the nanowires comprise a semiconductor selected from a group consisting of silicon, gallium arsenide, and indium phosphide.

9. The method of claim 1, wherein the nanoparticles comprise a metal.

10. The method of claim 1, wherein the nanoparticles have a shape selected from a group consisting of a cube, a sphere, a rod, a pyramid, and an octahedron.

11. The method of claim 1, wherein the nanoparticles have dimensions of about 2 nanometers to 30 nanometers.

12. The method of claim 1, wherein the second ligands comprise hydrocarbon chains comprising about 10 to 18 carbon atoms.

13. The method of claim 1, wherein the second ligands comprise functional groups selected from a group consisting of phosphine, amine, carboxylate, and thiol.

14. The method of claim 1, wherein the liquid is selected from a group consisting of hexane, chloroform, and toluene.

15. The method of claim 1, wherein a concentration of the plurality of nanoparticles in the liquid is about 0.1 milligrams per milliliter to 1 milligram per milliliter.

16. The method of claim 1, wherein substantially all of the liquid is evaporated in operation (c) in about 15 seconds to 1 minute.

17. A method comprising:

(a) providing an array of nanowires, the array of nanowires comprising a plurality of nanowires, ends of nanowires of the plurality of nanowires being attached to a substrate, the nanowires and the substrate comprising silicon;

(b) depositing a liquid on the array of nanowires in a drop-casting process, the liquid including a plurality of nanoparticles and including a plurality of first ligands, surfaces of nanoparticles of the plurality of nanoparticles having second ligands disposed thereon, the liquid comprising hexane, the plurality of nanoparticles comprising $Au_3Cu$; and (c) evaporating the liquid from the array of nanowires, the nanoparticles being deposited on the nanowires as a meniscus of the liquid recedes along lengths of the plurality of nanowires during evaporation of the liquid, a rate of the evaporating being controlled by a temperature at which the evaporating is performed and a vapor pressure of the liquid in a volume in which the evaporating is performed, the evaporating being performed at the temperature of about 10° C. to 50° C., the rate of the evaporating specified such that the nanoparticles are deposited on the nanowires with no aggregation of the nanoparticles.

18. The method of claim 1, wherein first ligands of the plurality of first ligands are the same composition as the second ligands.

19. The method of claim 1, wherein first ligands of the plurality of first ligands are a different composition than the second ligands.

20. The method of claim 1, wherein a concentration of the plurality of first ligands in the liquid is 0.01 milliliters to 0.02 milliliters per milliliter of the liquid.

* * * * *